US006159054A

United States Patent [19]

Ko

[11] Patent Number: 6,159,054

[45] **Date of Patent: *Dec. 12, 2000**

[54] ARRANGEMENT FOR PREVENTING MIS-MATING OF CONNECTOR ASSEMBLY

[75] Inventor: David Tso-Chin Ko, Thousand Oaks, Calif.

[73] Assignee: Hon Hai Precision Ind. Co., Ltd., Taipei Hsien, Taiwan

[ * ] Notice: This patent is subject to a terminal disclaimer.

[21] Appl. No.: 09/461,499

[22] Filed: Dec. 14, 1999

Related U.S. Application Data

[63] Continuation of application No. 09/075,508, May 8, 1998, Pat. No. 6,022,246.

[51] Int. Cl.[7] ..... H01R 13/64

[52] U.S. Cl. ..... 439/680

[58] Field of Search ..... 439/680, 681

[56] References Cited

U.S. PATENT DOCUMENTS 5,674,094 10/1997 Hutchinson ..... 439/680

*Primary Examiner*—Neil Abrams
*Assistant Examiner*—Javaid Nasri
*Attorney, Agent, or Firm*—Wei Te Chung

[57] ABSTRACT

An electrical connector assembly includes a male connector (10, 10') and a female connector (50, 50') wherein the male connector (10, 10') includes an insulative first. housing (12, 12') with at least one row of sleeve members (14, 14') extending forward for accommodating a corresponding number of receptacle contacts therein and the female connector (50, 50') includes an insulative second housing (52, 52') defining a same number of cavities (54, 54') therein for respectively receiving a corresponding number of plug contacts therein and further being adapted to respectively receive the corresponding sleeve members (14, 14') of the male connector (10) so that each plug contact can be engaged with the corresponding receptacle contact which is accommodated within the sleeve member (14, 14') which shares the same cavity (54, 54') with the plug contact. A pair of keys (18, 18') are respectively disposed on two sleeve members (14, 14') at two opposite ends, and a pair of keyways (58, 58') are respectively formed, adjacent to two cavities (54, 54') at two opposite ends, in the housing (52, 52') of the female connector (50, 50'), thus assuring only the male connector (10, 10') and the female connector (50, 50') having the same number of the mating ports, i.e., the sleeve members (14, 14') the cavities (54, 54'), can be mated with each other.

4 Claims, 6 Drawing Sheets

ARRANGEMENT FOR PREVENTING MIS-MATING OF CONNECTOR ASSEMBLY

CROSS-REFERENCED APPLICATION

This application is a continuous application (CA) of U.S. patent application Ser. No. 09/075,508 filed May 8, 1998, now granted as U.S. Pat. No. 6,022,246, issued on Feb, 8, 2000.

BACKGROUND OF THE INVENTION

1. Field of The Invention

The invention relates to electrical connector assemblies, and particularly to an arrangement or system for preventing incorrect mating between a male connector and a female connector both of which have inconsistent mating ports with each other.

2. The Prior Art

U.S. Pat. No. 4,979,912 discloses an electrical connector assembly of a matrix type having a pair of male connector and female connector mated with each other wherein a key is formed on the male connector to cooperate with a keyway in the female connector for anti-misorientation of mating of the connector assembly. Anyhow, the aforementioned '912 patent only teaches the "matrix type" connector assembly and the corresponding key and keyway structure respectively on the male connector and the female connector for assuring the correct orientation therebetween when mating.

Also, the '912 patent discloses the male connector having matrix type arranged sleeve members each with a receptacle contact therein for mating with the female connector having matrix type arranged cavities each with a plug contact therein whereby the receptacle contact of the male connector can electrically and mechanically engage the corresponding plug contact of the female connector.

In the actual practice, such type connector assemblies are not always of a matrix type, and most of time they are of a rectangular form. Moreover, there are so many types available in the market, for example, 2×2, 3×2, 4×2 . . . , N×2 in their colunm/row arrangement. Under this situation, a male connector having a less number of sleeve members may mistakenly inserted into some cavities of a female connector having a larger number of cavities in comparison with the male connector, if the operator carelessly picks the male connector and the female connector with the different numbers of mating ports thereof. This incorrect mating may result in damage of circuits of the whole system. Therefore, U.S. Pat. No. 5,342,221 introduces a method using the different positioned chamfers on some of the sleeve members, or so-called silos in the '221 patent, of the male connector to cooperate with the different positioned chamfers on the corresponding cavities of the female connector, so as to make sure that only the connectors having the same number of mating ports can be mated with each other, thus, preventing mis-mating between the male connector and the female connector having the different numbers of mating ports.

However, the '221 patent only discloses the so-called keying system from 1×2 to 12×2 positions while does not further disclose how such differently positioned chamfers should be arranged on both the male connector and the female connector. There is no specific formula or systematic method mentioned which can be a guidance of setting the chamfers on both the male connector and the female connector for achieving correct mating either in the series from 1×2 to 12×2 or above 12×2. The embodiment disclosed in the '221 patent seems to be a complicated result of a random selection with a try-and-error test. This deficiency may make the skilled person burdensome if he attempts to create another set of mating connector assembly, especially when the number of the matching ports exceeds 12×2 which is the biggest number disclosed in the '221 patent's embodiment.

Accordingly, an objective of the invention is to provide an understandable systematic and scientific way which is easy to follow for accomplishment of preventing mis-mating between the male connector and the female connector having the different numbers of mating ports with each other.

SUMMARY OF THE INVENTION

According to an aspect of the invention, an electrical connector assembly includes a male connector and a female connector wherein the male connector includes an insulative first housing with at least one row of sleeve members extending forward for accommodating a corresponding number of receptacle contacts therein and the female connector includes an insulative second housing defining a number of cavities therein for respectively receiving a corresponding number of plug contacts therein and further being adapted to respectively receive the corresponding sleeve members of the male connector so that each plug contact can be engaged with the corresponding receptacle contact which is accommodated within the sleeve member that shares the same cavity with the plug contact. A pair of keys are respectively disposed on two sleeve members at two opposite ends, and a pair of keyways are respectively formed, adjacent to two cavities at two opposite ends, in the housing of the female connector, thus assuring only the male connector and the female connector having the same number of the mating ports, i.e., the sleeve members/the cavities, can be mated with each other.

DETAILED DESCRIPTION OF THE PREFERRED EMBODIMENTS

Reference will now be in detail to the preferred embodiments of the invention. While the present invention has been described in with reference to the specific embodiments, the description is illustrative of the invention and is not to be constructed as limiting the invention. Various modifications to the present invention can be made to the preferred embodiments by those skilled in the art without departing from the true spirit and scope of the invention as defined by appended claims.

Figure 1A:
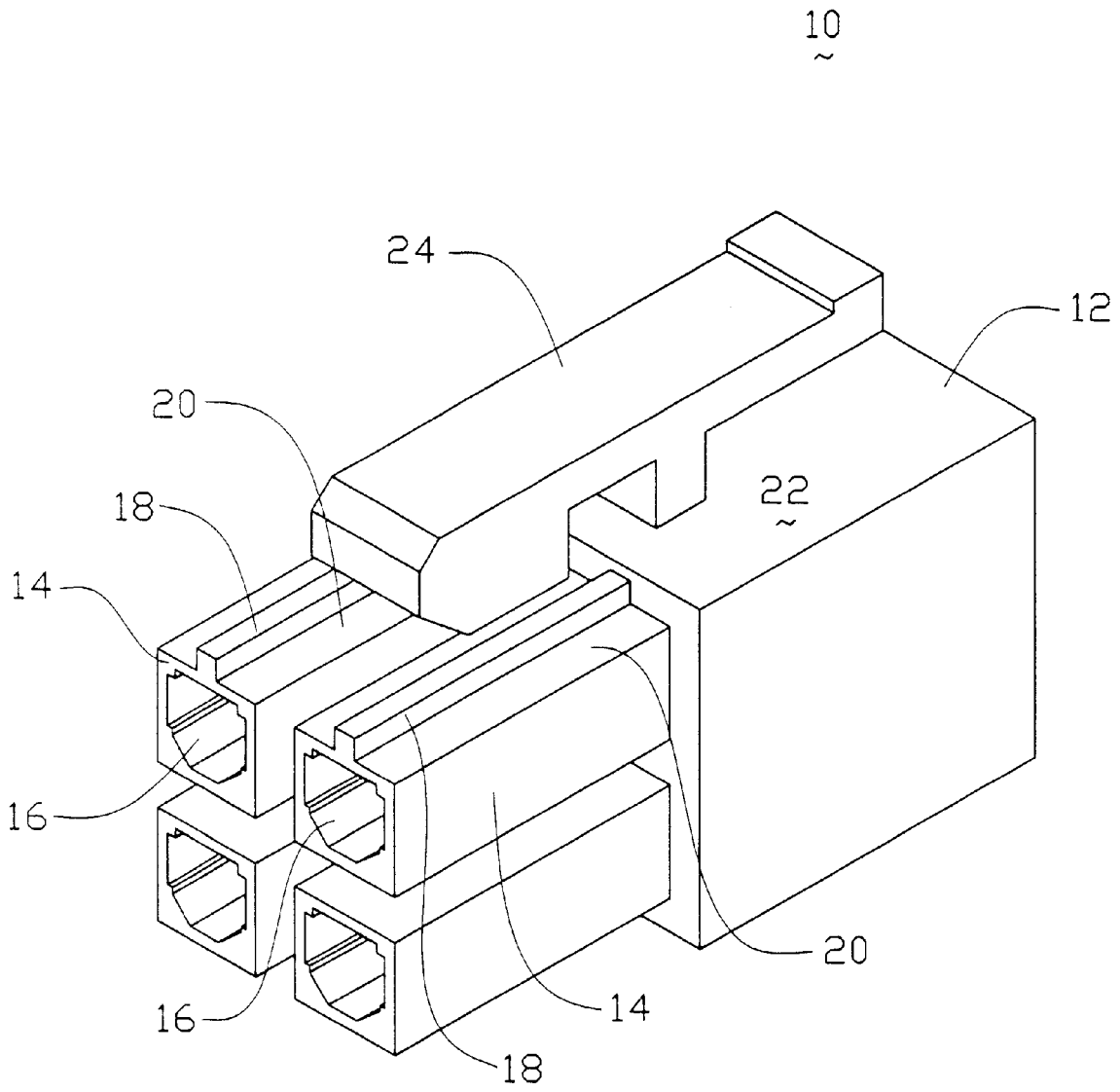
FIG. 1(A) is a perspective view of a male connector without contacts therein, according to the invention.
Figure 1B:
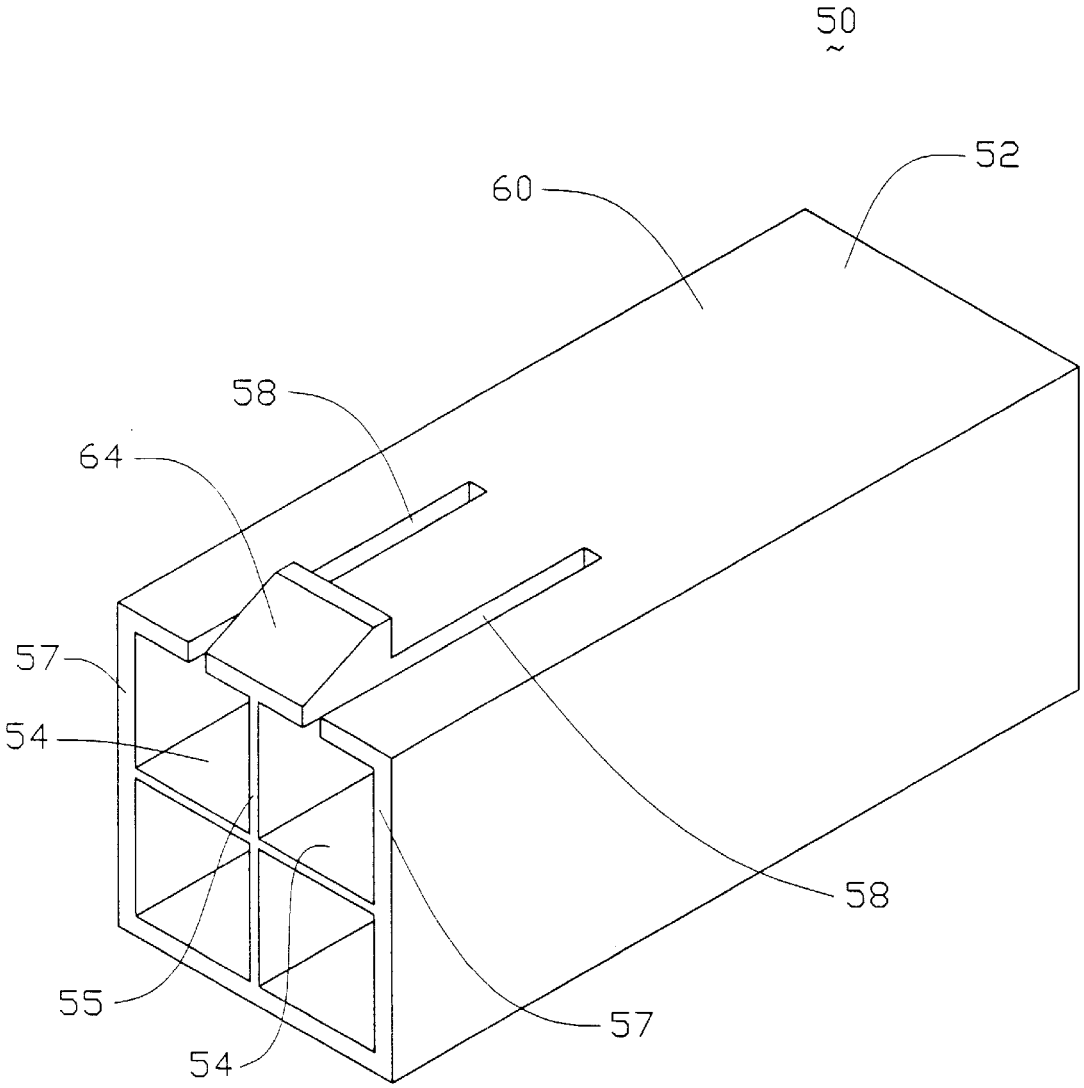
FIG. 1(B) is a perspective view of a female connector without contacts therein, according to the invention.

It will be noted here that for a better understanding, most of like components are designated by like reference numbers throughout the various figures in the embodiments. Attention is directed to FIGS. 1(A) and 1(B) wherein the electrical connector assembly includes a male connector 10 and a female connector 50 adapted to mate with each other.

The male connector 10 includes an insulative housing 12 with two rows of sleeve members 14 extending forward therefrom wherein each sleeve 14 defines a passageway 16 therethrough for accommodating a receptacle contact (not shown) therein. A pair of keys 18 are respectively formed on surfaces 20 of the right sleeve member 14 and of the left sleeve member 14 wherein the surface 20 is positioned adjacent to a top surface 22 of the housing 12 having a latch 24 thereon.

Correspondingly, the female connector 50 includes an insulative housing 52 with two rows of cavities 54 extending forward therefrom. Each cavity 54 is used for receiving a plug contact (not shown) therein. A pair of keyways 58 are formed adjacent to the right and left cavities 54 and in a top wall 60 of the housing 52 wherein a locking lug 64 is formed thereon.

Therefore, when assembled, the male connector 10 and the female connector 50 can be mated with each other by means that the sleeve members 14 can be correctly received within the corresponding cavities 54, respectively, under the condition that the keys 18 of the male connector 10 are snugly received within the corresponding keyways 58 of the female connector 50, respectively. Understandably, the receptacle contacts (not shown) of the male connector 10 are substantially electrically and mechanically engaged with the corresponding plug contacts (not shown) of the female connector 50, respectively.

Figure 2A:
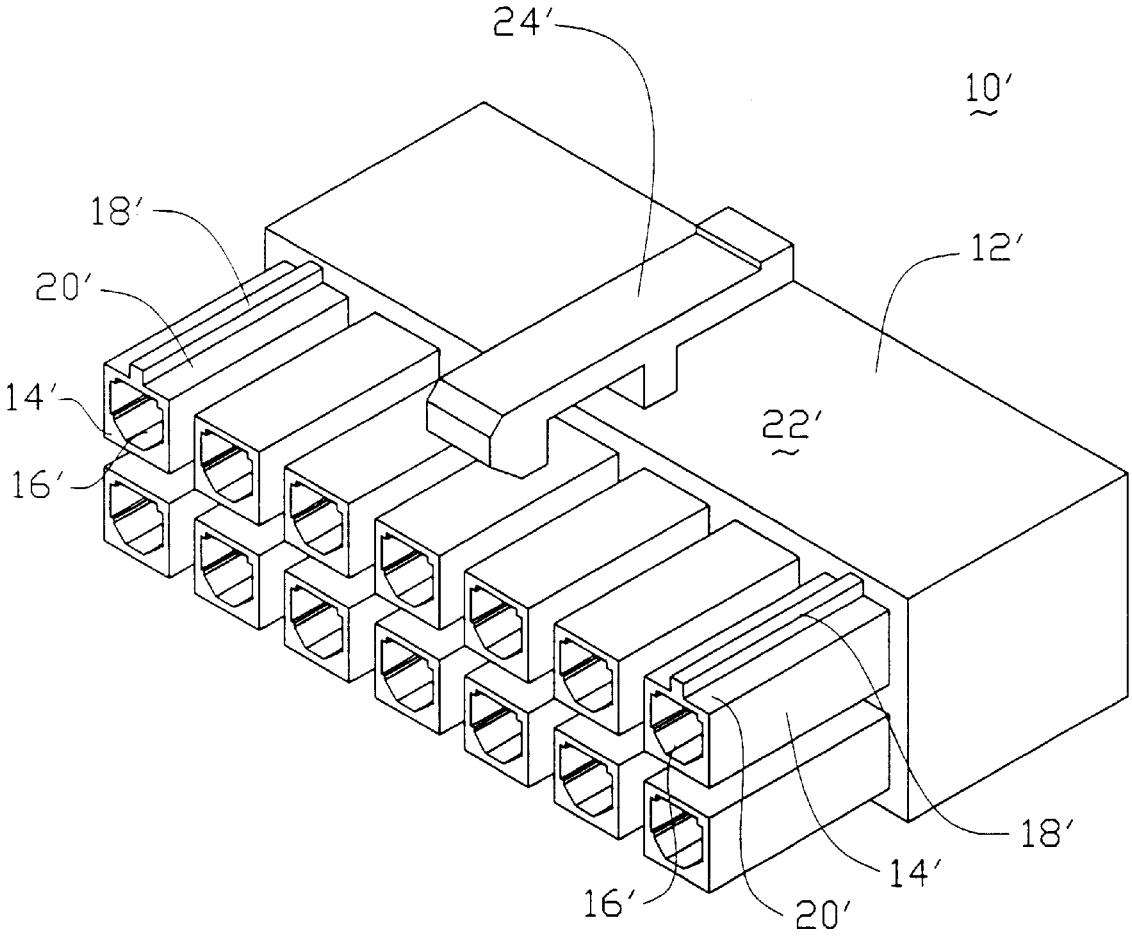
FIG. 2(A) is a perspective view of a male connector, without contacts therein, while having the different number of mating ports to the male connector shown in FIG. 1(A), according to the invention.
Figure 2B:
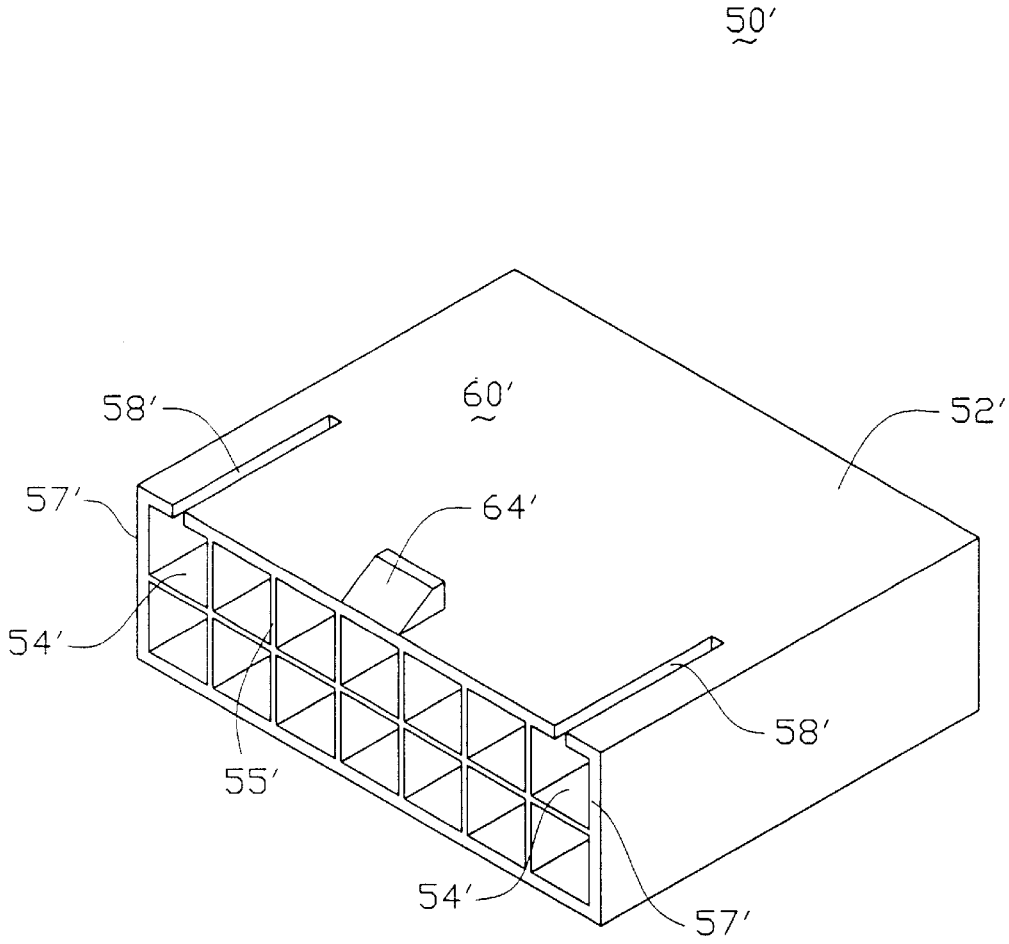
FIG. 2(B) is a perspective view of a female connector, without contacts therein, while having the different number of mating ports to the female connector shown in FIG. 1(B), according to the invention.

Similarly, referring to FIGS. 2(A) and 2(B), the male connector 10' includes an insulative housing 12' with two rows of sleeve members 14' extending forward therefrom wherein each sleeve member 14' defines a passageway 16' therethrough for accommodating a receptacle contact (not shown) therein. A pair of keys 18' are respectively formed on surfaces 20' of the outermost right and left sleeve members 14' wherein the surfaces 20' are positioned adjacent to a top surface 22' of the housing 12' having a latch 24' thereon.

Likewise and correspondingly, the female connector 50' includes an insulative housing 52' with two rows of cavities 54' extending forward therefrom. Each cavity 54 is used for receiving a plug contact (not shown) therein. A pair of keyways 58' are formed adjacent to the outermost right and left cavities 54', i.e., the cavities at two opposite lengthwise ends. The keyways 58' are located in a top wall 60' of the housing 52' wherein a locking lug 64' is formed thereon.

Understandably, the assembling of the male connector 10' and the female connector 50' is similar to that of the male connector 10 and the female connector 50 as mentioned before.

Accordingly, the rule for positioning of the key 18(18') and the corresponding keyway 58(58') is simple and systematic wherein only two keys 18(18') are respectively disposed on the sleeve members 14(14') at two opposite lengthwise ends thereof, and only two keyways 58(58') are respectively disposed in walls adjacent to the cavities at two opposite lengthwise ends thereof. In this embodiment, the key 18(18') is positioned on the top surface 22(22') of the housing 12(12') and the keyway 58(58') is disposed in the top wall 60(60') of the housing 52(52'), correspondingly. It can be appreciated that the key 18(18') or the keyway 58(58') can be disposed adjacent to other sides for each sleeve member 14(14') or cavity 54(54') as long as the key 18(18') and the corresponding keyway 58(58') can reach the consistent orientation with each other.

Based on the aforementioned arranged rule, only the male connector 10(10') and the corresponding female connector 50(50') having the same number of mating ports, i.e., the sleeve members 14(14') or the cavities 54(54'), can match with each other. The incorrect mating of the male connector and the female connector will be prohibited by means of the interference between the unmated key and keyway.

It is noted that in this embodiment only two keys and keyways are used for each pair of male and female connectors while more than two keys/keyways may be disposed thereon or thereof for further other consideration such as identification.

It is also contemplated that because there is a thickness difference between a partition wall 55(55') beside the cavity 54(54') and an end(side) wall 57(57'), the mis-mating generally occurs only on the condition that the number of the sleeve members 14(14') of the male connector 10(10') is smaller than that of the cavities 54(54') of the female connector 50(50').

Figure 3A:
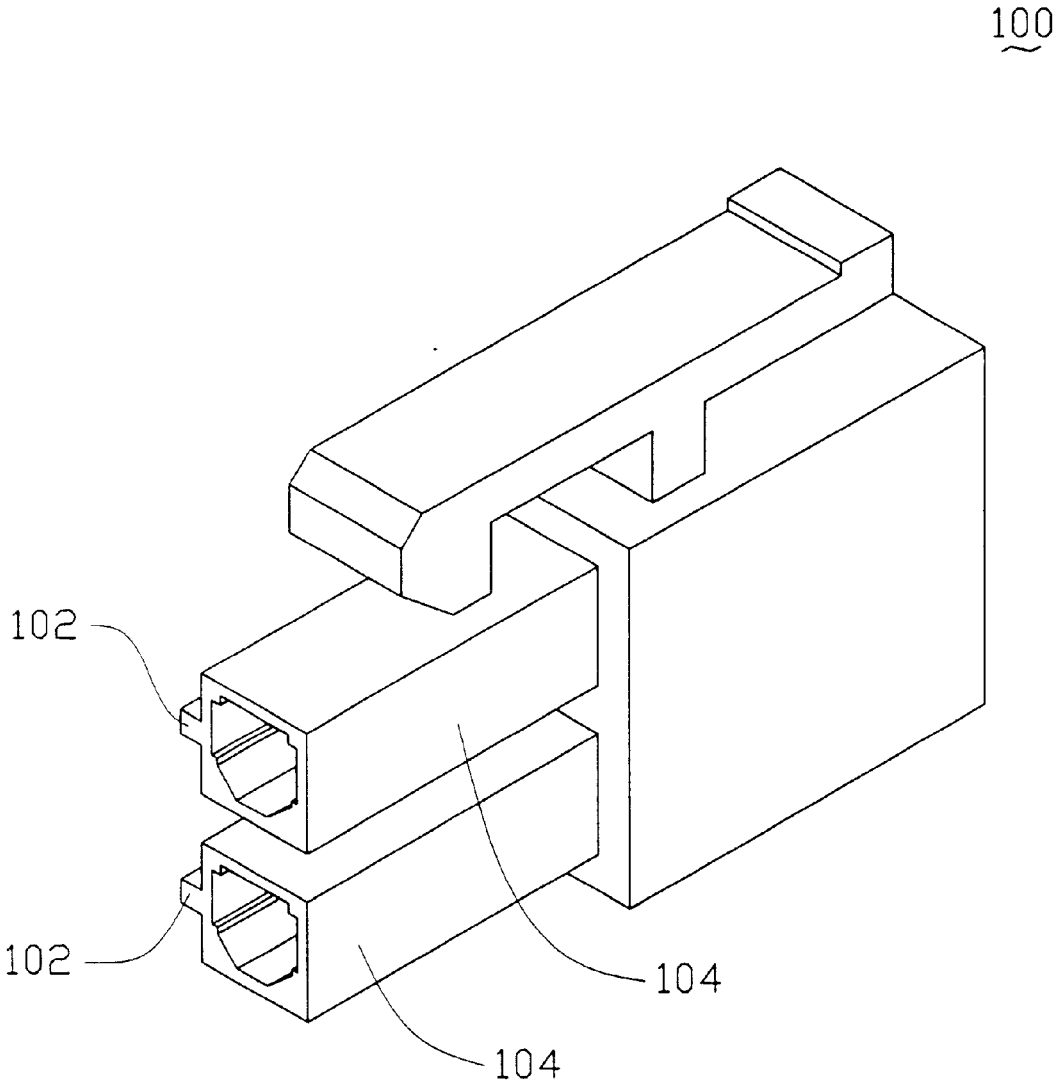
FIG. 3(A) is a perspective view of the male connector without contacts therein, while having the different number of mating ports to the female connector shown in either FIG. 1(A) or FIG. 2(A).
Figure 3B:
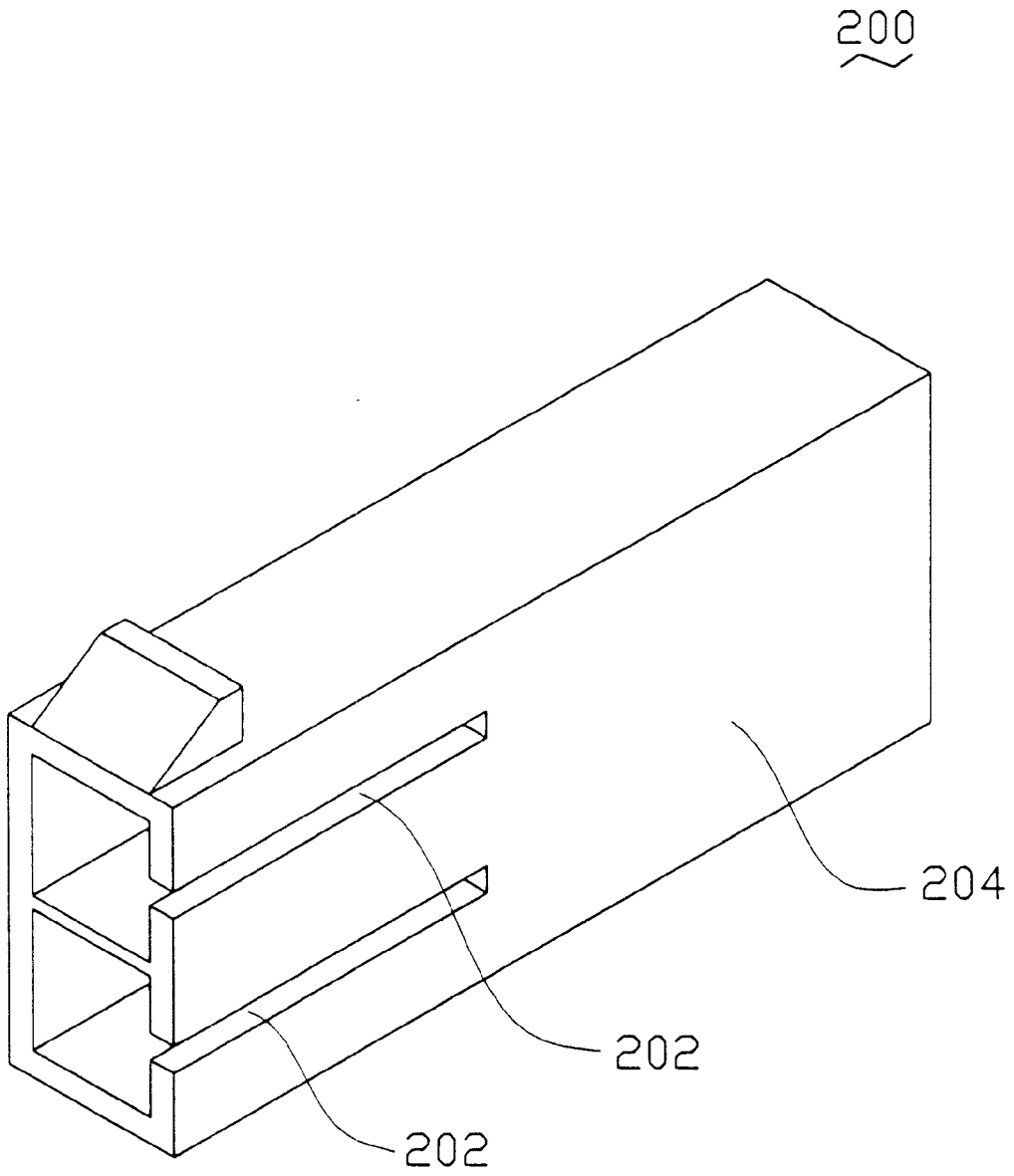
FIG. 3(B) is a perspective view of the female connector without contacts therein, while having the different number of mating ports to the female connector shown in either FIG. 1(B) or FIG. 2(B).

The aforementioned key/keyway arrangement rule is generally applied to the connector assembly having at least two columns of mating ports because it requires such pair of keys/keyways be positioned on two different sleeve members/cavities in the lengthwise direction of the housing. Anyhow, the connector assembly having only one column mating ports, can be referred to FIGS. 3(A) and 3(B) wherein two keys 102 are positioned on a left side of sleeve members 104 of a male connector 100 for cooperation with corresponding keyways 202 in a left side wall of a female connector 200.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, person of ordinary skill in this field are to understand that all such equivalent structures are to be included within the scope of the following claims.

I claim:

1. An arrangement for correctly assembling an electrical connector assembly, comprising:

a male connector including a first housing defining at least two columns and least two rows of sleeve members extending forward from the first housing;

a female connector including a second housing having an outer wall defining at least two rows and two columns of cavities therein; wherein two sleeve members at two opposite ends of the first housing each have a first configured structure so that the two sleeve members respectively having the first configured structures have a configuration different from that of other sleeve members; and two portions of the outer wall of the second housing adjacent to two opposite ends of the second housing each have a second configured structure complementary the first configured structure; whereby only when an amount of the sleeve members of the male connector is equal to that of the cavities of the female connector, said male and female connectors can be mated with each other to form the connector assembly.

2. An electrical connector assembly, including:

a male connector, comprising:

a first housing having a front face for engaging with a mating female connector, two lateral walls extending rearwardly from two lateral sides of the front face and a top wall in rear of the front face and between the two lateral walls;

a number of sleeve members arranged in at least two parallel rows extending forward from the front face of the first housing, each sleeve member being used for receiving a contact therein;

at least two first configured structures; formed at two of the sleeves near the two lateral walls and the top wall of the housing so that the two sleeves respectively having the first configured structures have a configuration different from that of other sleeves; and a female connector, comprising:

a second housing having two lateral walls and a top wall between the two lateral walls;

a number of cavities arranged in at least two parallel rows in the second housing, each cavity being used for receiving a contact therein;

at least two second configured structures complementary to the first configured structures being formed at two of the cavities near the two lateral walls and the top wall of the second housing;

whereby only when an amount of the sleeve members of the male connector is equal to that of the cavities of the female connector, said male and female connectors can be mated with each other to form the connector assembly.

3. An arrangement for correctly assembling an electrical connector assembly, comprising:

a male connector including a first housing defining at least two columns of sleeve members extending forward from the first housing;

a female connector including a second housing having an outer wall defining at least one row and two columns of cavities therein; wherein two sleeve members at two opposite ends of the first housing each have a first configured structure so that the two sleeves respectively having the first configured structure have a configuration different from that of other sleeve members; and two portions of the outer wall of the second housing adjacent to two opposite ends of the second housing each have a second configured structure through the outer wall, when the male connector mates the female connector, the first configured structures having a mating fit with the second configured structures; whereby only when an amount of the sleeve members of the male connector is equal to that of the cavities of the female connector, said male and female connectors can be mated with each other to form the connector assembly.

4. An interconnection system comprising:

a male connector including a first housing defining a plurality of columns of sleeve members extending forwardly from the first housing;

a female connector including a second housing defining a plurality of columns of cavities therein;

each of the two sleeve members which is positioned at either opposite ends of the first housing, defining a first configured structure which is different from those of remaining sleeve members of the male connector; and each of the two cavities which is positioned at either opposite ends of the second housing, defining a second configured structure which is different from those of remaining cavities of the female connector and extends through an outer wall of the second housing, the outer wall defining the cavities therein; wherein the first configured structure is compliantly fit for the second configured structure, and the configured structures of the remaining sleeve members of the male connector are compliantly fit for those of the remaining cavities of the female connector, while the first configured structure is not compliantly fit for those of the remaining cavities of the female connector, and the second configured structure is not compliantly fit for those of the remaining sleeve members of the male connector; whereby only when an amount of the sleeve members of the male connector is equal to that of the cavities of the female connector, said male and female connectors can be mated with each other through the corresponding sleeve members and cavities being aligned and coupled with each other, respectively.

* * * * *